United States Patent [19]

Thomas

[11] Patent Number: 4,764,892

[45] Date of Patent: Aug. 16, 1988

[54] FOUR QUADRANT MULTIPLIER

[75] Inventor: Vincent P. Thomas, Eastleigh, England

[73] Assignee: International Business Machines Corporation, Armonk, N.Y.

[21] Appl. No.: 741,519

[22] Filed: Jun. 5, 1985

[30] Foreign Application Priority Data

Jun. 25, 1984 [EP] European Pat. Off. ..... 84304302.7

[51] Int. Cl.[4] ..... G06G 7/16

[52] U.S. Cl. ..... 364/841; 328/160

[58] Field of Search ..... 364/841, 857, 800, 807; 328/160; 330/252, 257, 258, 310, 353

[56] References Cited

U.S. PATENT DOCUMENTS

| | | | |
|---|---|---|---|
| T886006 | 5/1971 | Nichols | 364/841 X |
| 3,670,155 | 6/1972 | Grobert | 328/160 |
| 3,689,752 | 9/1972 | Gilbert | 328/160 X |
| 3,838,262 | 9/1974 | van de Plassche | 364/841 X |
| 4,101,842 | 7/1978 | Ohsawa | 330/257 |
| 4,156,283 | 5/1979 | Gilbert | 364/841 |

FOREIGN PATENT DOCUMENTS 1347182 2/1974 United Kingdom .

OTHER PUBLICATIONS

Proceedings of the IEEE, vol. 65, No. 12, Dec. 1977, pp. 1721–1723, IEEE. New York, US: S. Pookaiyaudom et al., "High-Performance Differential Quartets". IEEE Journal of Solid-State Circuits, vol. Sc-3, No. 4, Dec. 1968, pp. 365–373, New York, US; B. Gilbert, "A Precise Four-Quadrant Multiplier with Subnanosecond Response."

*Primary Examiner*—Gary V. Harkcom
*Attorney, Agent, or Firm*—Frederick D. Poag

[57] ABSTRACT

A linear output multiplier has two pairs of differentially connected multiplying transistors (T13, T14 and T15 T16). One value Vx to be multiplied is supplied to the differential inputs of differential amplifier 1 and converted to corresponding differential currents I1 and I2. These currents are supplied to semiconductor junctions which generate logarithmically distorted voltages representing the one value Vx which are applied to the control electrodes of the multiplying transistors. The second value Vy to be multiplied is supplied to the differential inputs of differential amplifier 2 and converted to corresponding differential currents I3 and I4. The outputs from amplifier 2 are connected respectively to the tail connections of the two differential pairs of multiplier transistors. The outputs of the multiplying transistors are cross-coupled to provide four quadrant multiplying functions. Zero signal offset errors due to device Vbe mismatch are corrected by injecting a current equal to the standing current of the differential amplifier 2 into the two outputs of the differential amplifier. This means that with zero differential input to the amplifier (Vy=0) no current flows through the multiplying transistors and the zero output condition is ensured. Furthermore, any residual errors for non-zero input signals are proportional to the applied input signal Vy. The injected currents are developed by an additional current source (T24, R24) and current mirror arrangement (T17, T18, T19, and T25).

8 Claims, 3 Drawing Sheets

FOUR QUADRANT MULTIPLIER

TECHNICAL FIELD

The invention relates to four quadrant analogue multiplier circuits and in particular to an improvement in such circuits for reduction of errors of operation due to device characteristic mismatch.

BACKGROUND ART

Four quadrant multiplier circuits are well known in the art and widely described in technical literature. For such a description, reference should be made for example to the article "A Precise Four Quadrant Multiplier with Sub-nanosecond Response" by B Gilbert, IEEE Journal of Solid State Circuits, Vol SC-3, No. 4, December 1968, pages 365 to 373 or to a more recent description in the text book Integrated Circuit Engineering by Glaser, Subak-Sharpe in the general section 13.6 Analog Multipliers, and in particular in Section 13.6.3 Current Ratioing Multiplier, pages 564 to 566.

The multiplying function of a four quadrant multiplier such as described in the above references is achieved by two pairs of differentially connected transistors, the outputs from which are cross-coupled. Briefly, one value to be multiplied is applied as a differential voltage to the bases of the two pairs of differentially connected transistors and a second value to be multiplied is applied as a differential current to the tail connections of the two differentially connected pairs. In order to compensate for the non-linear action of the differential pairs, the one value, itself initially developed as a differential current, is converted to a differential voltage pre-distorted by semiconductor junction devices to be logarithmically related to the differential currents it represents before it is applied to the bases of the two differential pairs of transistors. The ensuing exponential distortion which occurs in the two differential pairs is cancelled by this previous logarithmic conversion of one of the factors to be multiplied.

In untrimmed designs of such multipliers, errors arise from the Vbe mismatch of the four transistors constituting the two cross-coupled differential pairs and from Vbe mismatch of the pre-distorting transistors T5 and T6. Given the normal adjacent device matching of 2 mV for integrated circuit constructions, these devices could give rise to a 3 sigma error of 2.7% of the maximum signal swing. In most designs, the maximum signal swing is arranged to be less than twice the standing tail current of the differential pairs in order to avoid clipping under worst case tolerances. This can lead to a doubling of the percentage error. Furthermore, this error is independent of the output signal level. Accordingly, for low output signal levels, the error as a percentage of the signal is proportionately high and can be intolerably large for some applications.

It is therefore an object of the invention to provide a four-quadrant multiplier with an improved error performance.

DISCLOSURE OF THE INVENTION

In a multiplier circuit in which the multiplication of two signal values is achieved by means of a pair of differentially connected transistors having control electrodes to which a differential voltage representative of a first electrical value to be multiplied is applied, and having a tail connection connected to one of two differential outputs of a differential amplifier, to the inputs of which a differential voltage representing a second electrical value to be multiplied is applied, the improvement according to the present invention comprising current supply means connected to said one output of said differential amplifier to supply current thereto, the magnitude of which is such that with zero differential voltage applied as input to the differential amplifier, the standing current of said amplifier is supplied solely from said current supply means and no current flows through the tail connection of said differentially connected pair of transistors.

BRIEF DESCRIPTION OF THE DRAWINGS

In order that the invention may be fully understood, a preferred embodiment thereof will now be described with reference to the accompanying drawings. In the drawings.

BEST MODE FOR CARRYING OUT THE INVENTION

Figure 1:
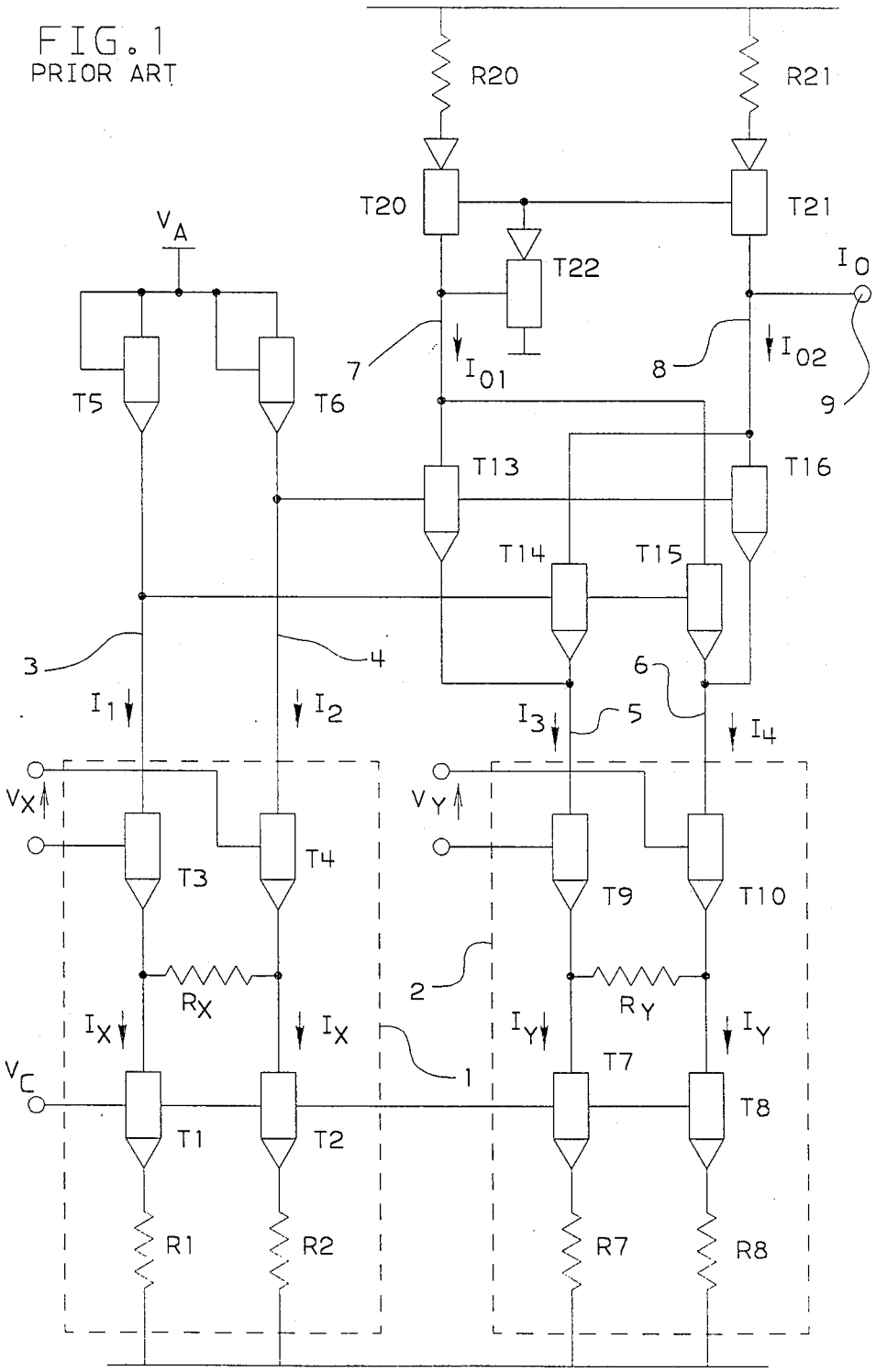
FIG. 1 PRIOR ART
FIG. 1 shows a conventional four quadrant multiplier.

In the four quadrant multiplier shown in FIG. 1, a first electrical value Vx to be multiplied is applied as input to differential amplifier 1 for proportioning the constant standing currents Ix of the amplifier as output currents I1 and I2 on the two output lines 3 and 4 respectively from the amplifier. The differential amplifier in this example is shown to consist conventionally of two transistors T3 and T4 with their emitter terminals connected together through resistor Rx and to identical current sources formed from transistor T1 resistor R1 and transistor T2, resistor R2 combinations respectively. The two current sources generate equal standing current Ix for the differential amplifier 1. Accordingly, with differential amplifier 1 held at the bias level with no differential input signal applied i.e., Vx=0, no differential output currents are produced on output lines 3 and 4 whereby I1=I2=Ix.

Similarly, a second electrical value Vy to be multiplied is applied as input to differential amplifier 2 for proportioning its constant standing currents Iy as output currents I3 and I4 on the two output lines 5 and 6. The differential amplifier consists of two transistors T9 and T10 with their emitter terminals connected together through resistor Ry and to identical current sources formed from transistor T7, resistor R7 and transistor T8, resistor R8 combinations respectively. The two current sources generate equal standing currents Iy for the differential amplifier 2. Accordingly, with differential amplifier 2 held at the bias level with no differential input signal applied i.e., Vy=0, no differential output currents are produced on output lines 5 and 6 whereby I3=I4=Iy.

The multiplying function is performed by two pairs of differentially connected transistors T13, T14 and T15, T16. Output line 3 from differential amplifier 1 is connected to the base terminals of transistors T14, T15 and output line 4 is connected to the base terminals of transistors T13, T16. A pair of semiconductor junction devices provided by transistors T5 and T6 are respectively connected to the output lines 3 and 4. The non-linear characteristics of these junctions produce voltages which are logarithmically related to the values of the output currents I1 and I2 from differential amplifier 1. It is these pre-distorted differential signals representative of the Vx input value that are applied as base inputs to the two pairs of multiplying transistors T13, T14 and T15, T16. Output line 5 is connected to the emitter terminals of transistors T13, T14 and output line 6 is connected to the emitter terminals of transistors T15, T16. The four quadrant multiplying operation is completed by cross-coupling the outputs of the collector terminals of the multiplying transistors. Thus the collector terminals of transistors T13 and T15 are connected together and the collector terminals of transistors T14 and T16 are connected together.

The magnitude and sign of the differential output current IO1 and IO2 generated on the output lines 7 and 8 respectively is representative of the product of the input signals Vx and Vy. Mirror circuit transistors T20, T21, T22 and associated resistors R21, R22 convert the differential current on the two output lines to a single ended output signal IO at output terminal 9.

Nominal Analysis of Four Quadrant Multiplier Action $$IO = IO1 - IO2$$
Define $\delta x$ such that $I1 = Ix(1-\delta x) = Ix - Vx/Rx$
$$I2 = Ix(1+\delta x) = Ix + Vx/Rx$$
where $\delta x = Vx/IxRx$
Define $\delta y$ such that $I3 = Iy(1-\delta y) = Iy - Vy/Ry$
$$I4 = Iy(1+\delta y) = Iy + Vy/Ry$$
where $\delta y = Vy/IyRy$ Assume that transistor T5 is identical to transistor T6
transistor T13 is identical to transistor T14
transistor T15 is identical to transistor T16

Then $Ic(T13)/Ic(T14) = Ic(T16)/Ic(T15) = I1/I2 = (1-\delta x)/(1+\delta x)$ and $Ic(T13)/Ic(T14) = 13 = Iy(1-\delta y)$
$Ic(T15)/Ic(T16) = I4 = Iy(1+\delta y)$ Hence
$$Ic(T13) = \tfrac{1}{2}Iy(1-\delta x)(1-\delta y)$$
$$Ic(T14) = \tfrac{1}{2}Iy(1+\delta x)(1-\delta y)$$
$$Ic(T15) = \tfrac{1}{2}Iy(1+\delta x)(1+\delta y)$$
$$Ic(T16) = \tfrac{1}{2}Iy(1-\delta x)(1+\delta y)$$

Now $IO1 = Ic(T13) + Ic(T15) = Iy(1+\delta x\delta y)$
and $IO2 = Ic(T14) + Ic(T16) = Iy(1-\delta x\delta y)$
Hence $IO = IO1 - IO2 = 2Iy\delta x\delta y = 2VxVy/IxRxRy$ From this final expression it is observed that the output current IO is independent of the value of standing current Iy.

Effect of Vbe vs. Ie Characteristic Mismatch

Device Vbe vs. Ie characteristic mismatch is most conveniently treated as a ratio of the saturation currents or areas of the emitter junctions.

$$Ie1/Ie2 = A1/A2 \exp.((Vbe1 - Vbe2)/Vt)$$

which rewritten gives $$Vbe1 - Vbe2 = Vt \ln.((Ie1/Ie2)(A2/A1))$$

where A1 is the emitter area of transistor T1, A2 is the emitter area of transistor T2 and so on. $Vt = kT/q$ where q=charge on electron, k=Boltzmann's constant and T=absolute temperature. Considering the transistors T13, T14, T15, T16 and diodes T5, T6 of the four quadrant multiplier shown in FIG. 1:

Define $\Delta V = Vbe(T5) - Vbe(T6) = Vt\ln.((I1/I2)(A6/A5))$

Then for $Vx = 0$
$I1 = I2$ and $\Delta V = Vt\ln.(A6/A5)$

With $\Delta V$ applied to transistors T13 and T14
$Ic(T13)/Ic(T14) = (A13/A14)\exp.(\Delta V/Vt)$ -continued and $\Delta V$ applied to transistors T15 and T16
$Ic(T15)/Ic(T16) = (A15/A16)\exp.(-\Delta V/Vt)$ Define $\Delta 1$ such that $A13/A14 = (1+\Delta 1)/(1-\Delta 1)$
$\Delta 2$ such that $A15/A16 = (1+\Delta 2)/(1-\Delta 2)$
$\Delta 3$ such that $A6/A5 = (1+\Delta 3)/(1-\Delta 3) = \exp.(\Delta V/Vt)$ Therefore $Ic(T13)/Ic(T14) = (1+\Delta 1)(1+\Delta 3)/(1-\Delta 1)(1-\Delta 3)$ and $Ic(T15)/Ic(T16) = (1+\Delta 2)(1-\Delta 3)/(1-\Delta 2)(1+\Delta 3)$ Now $Ic(T13) + Ic(T14) = I3$ which gives
$$Ic(T13) = \tfrac{1}{2}I3(1+\Delta 1)(1+\Delta 3)/(1+\Delta 1\Delta 3)$$
$$Ic(T14) = \tfrac{1}{2}I3(1-\Delta 1)(1-\Delta 3)/(1+\Delta 1\Delta 3)$$

and $Ic(T15) + Ic(T16) = I4$ which gives
$$Ic(T15) = \tfrac{1}{2}I4(1+\Delta 2)(1-\Delta 3)/(1-\Delta 2\Delta 3)$$
$$Ic(T16) = \tfrac{1}{2}I4(1-\Delta 2)(1+\Delta 3)/(1-\Delta 2\Delta 3)$$

$$IO = IO1 - IO2 = (Ic(T13) + Ic(T15)) - (Ic(T14) + Ic(T16)) = (Ic(T13) - Ic(T14)) + (Ic(T15) - Ic(T16))$$
$$Ic(T13) - Ic(T14) = I3(\Delta 1 + \Delta 3)/(1 + \Delta 1\Delta 3)$$
$$Ic(T15) - Ic(T16) = I4(\Delta 2 - \Delta 3)/(1 - \Delta 2\Delta 3)$$
Therefore $IO = I3(\Delta 1 + \Delta 3)/(1 + \Delta 1\Delta 3) + I4(\Delta 2 - \Delta 3)/(1 - \Delta 2\Delta 3)$ Substituting for $I3 = Iy(1-\delta y)$
and $I4 = Iy(1+\delta y)$ gives
$$IO = Iy(1-\delta y)(\Delta 1 + \Delta 3)/(1 + \Delta 1\Delta 3) + Iy(1+\delta y)(\Delta 2 - \Delta 3)/(1 - \Delta 2\Delta 3)$$

Re-arranging
$$IO = Iy\delta((\Delta 2 - \Delta 3)/(1 - \Delta 2\Delta 3) - (\Delta 1 + \Delta 3)/(1 + \Delta 1\Delta 3)) + Iy((\Delta 2 - \Delta 3)/(1 - \Delta 2\Delta 3) + (\Delta 1 + \Delta 3)/(1 + \Delta 1\Delta 3))$$
Substituting for $Iy\delta y = Vy/Ry$ gives
$$IO = (Vy/Ry)(\Delta 2 - \Delta 3)/(1 - \Delta 2\Delta 3) - (\Delta 1 + \Delta 3)/(1 + \Delta 1\Delta 3) + Iy((\Delta 2 - \Delta 3)/(1 - \Delta 2\Delta 3) + (\Delta 1 + \Delta 3)/(1 + \Delta 1\Delta 3))$$

From this expression for output current IO it is seen that for input conditions Vx=0, IO is nominally zero for all values of Vy. It should also be noted that IO has a zero offset term that is independent of Vy and proportional to the standing current Iy. It should also be noted that IO has a zero offset term that is proportional to Vy. The expression for output current IO reduces under selected input conditions to the following:

For $Vx = 0$, $Vy = 0$
$$IO = Iy((\Delta 2 - \Delta 3)/(1 - \Delta 2\Delta 3) + (\Delta 1 + \Delta 3)/(1 + \Delta 1\Delta 3))$$
For $Vx = 0$, $Vy = \max(+ve)$, $\delta y = +1$
$$IO = 2Iy(\Delta 2 - \Delta 3)/(1 - \Delta 2\Delta 3)$$
For $Vx = 0$, $Vy = \max(-ve)$, $\delta y = -1$
$$IO = 2Iy(\Delta 1 + \Delta 3)/(1 + \Delta 1\Delta 3)$$

The dominant error term in the four quadrant multiplier circuit is due to the Vbe mismatch of transistors T5, T6, T13, T14, T15, T16. It is not possible to reduce this error by the introduction of emitter resistors as these would seriously distort the linearity of the multiplier. From the analysis given above for the case of Vx=0 the expression for IO is seen to have two terms. The first is proportional to the Vy input and the second is proportional to the standing current Iy. The second term dominates for all Vy inputs less than full scale.

It has been shown (IEEE Journal of Solid State Circuits, December 1968) that variation of the error with respect to the Vx input is of parabolic form being zero at the extremes and a maximum for zero input. From the implementation of the circuit in FIG. 1 it is seen that for the condition where both input signals Vx and Vy are zero, equal currents I3 and I4 are passed through transistors T13 and T14 and T15 and T16 respectively producing the errors outlined previously. The sum of the collector currents of transistors T13 and T15 are then inverted and subtracted from the sum of the collectors of transistors T14 and T16.

This inversion process adds its own error which again is proportional to the standing current Iy. In the present invention, the standing tail currents are subtracted from the signal at the collectors of transistors T9 and T10 and only the remaining positive-going portions of the signal passes on to transistors T13, T14, T15 and T16 and the output inversion circuit.

Figure 2A:
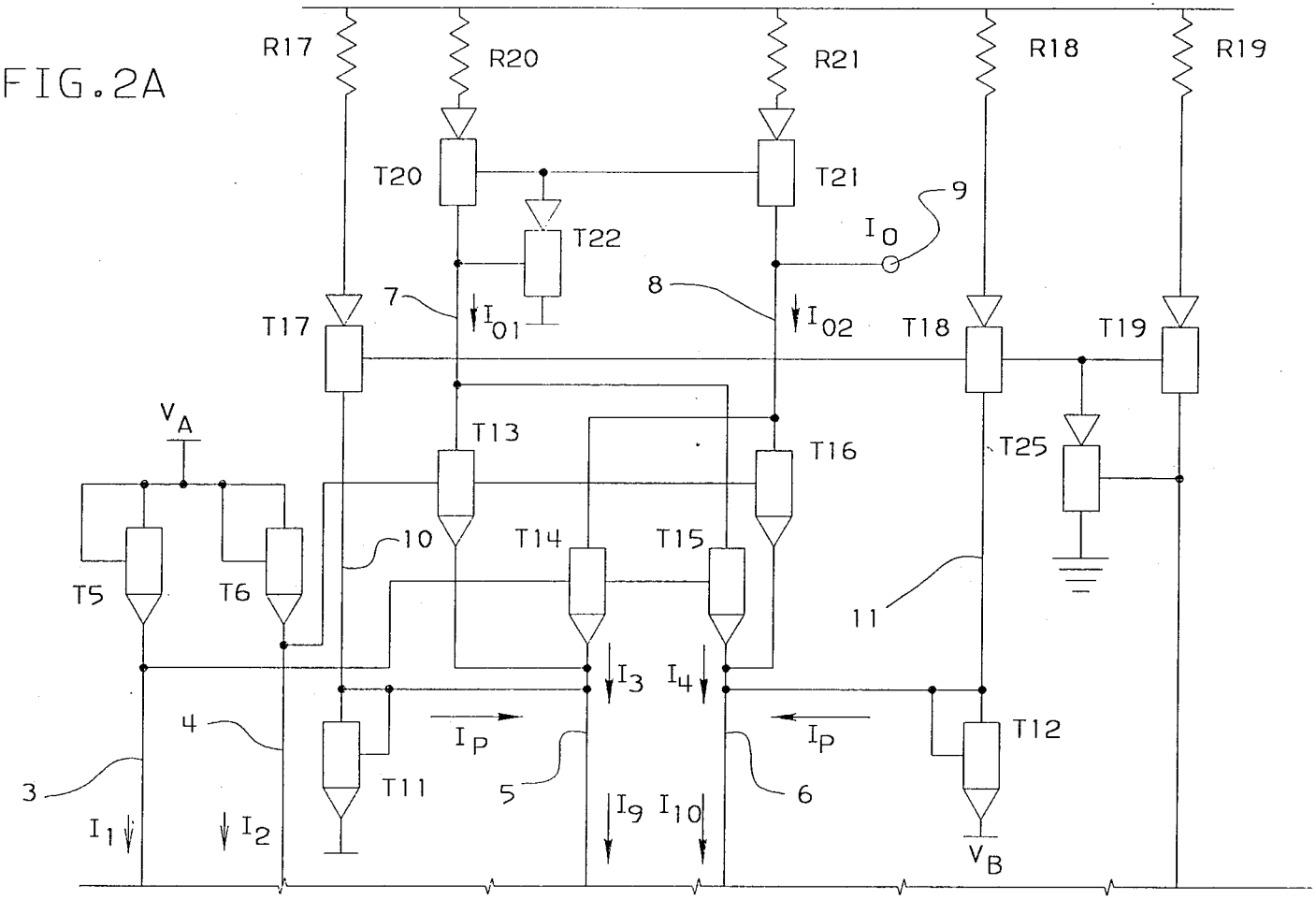
FIG. 2 shows an improved four quadrant multiplier in accordance with the present invention.
Figure 2B:
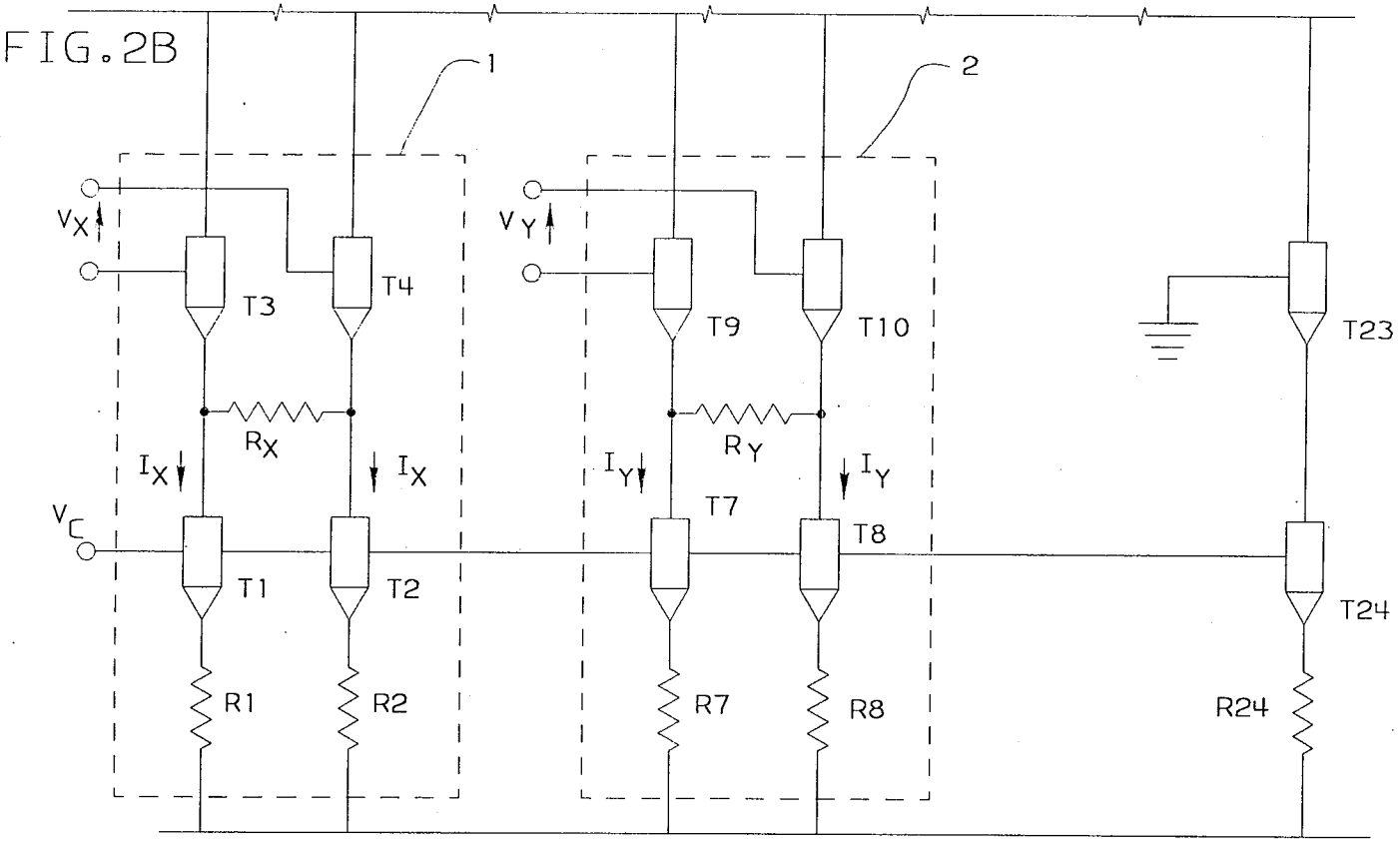

FIG. 2 shows the four quadrant multiplier of FIG. 1 modified in accordance with the present invention. Since as has been shown, a major source of error comes from the effects of Vbe mismatch of transistors T13, T14, T15 and T16 on the output currents I3, I4 from the differential amplifier 2, and since I3=I4=Iy for Vy=0, the standing currents Iy of the two current source forming part of differential amplifier 2 are supplied, not through the four differentially connected multiplying transistors T13, T14, T15 and T16, but through separate circuit paths connected to output lines 3 and 4 provided with appropriately valued currents from an independent source. With this arrangement, differential amplifier 2 operating at its bias level with no differential input signal applied (Vy=0) derives all its standing current from the auxiliary circuit paths, none flows through the multiplying transistors and accordingly the output IO from terminal 9 is truly zero.

The standing current supplied to the additional circuit paths for differential amplifier 2 is generated by an additional current source formed from transistor T24, resistor R24 combination. This source is coupled to and is identical with the two sources in differential amplifier 2 and accordingly generates an identical current Iy. This current is passed through transistor T23 in order to compensate for the alpha loss of transistors T9 and T10 and is mirrored by the pnp transistor T17, T18, T19, T25 combination to reflect identical current values Iy in the two lines 10 and 11 connected respectively to the collector output lines 5 and 6 of differential amplifier 2. The values of the emitter resistors R17, R18, R19, R20, R21 of the pnp transistors are chosen to give a voltage on the collector of transistor T19 equal to the collector voltages of transistors T9 and T10 to minimise the early effect variations on the collector currents of transistors T17, T18 and T19. Transistors T11 and T12 are connected to operate as diodes and are connected between the output lines 10 and 11 respectively and a reference voltage $V_B$. When the collector current of transistor T9 falls below the collector current of transistor T17, diode T11 turns on and supplies the required current deficit. Similarly diodes T12 turns on when the collector current of transistor T10 falls below that of transistor T18 to supply the current deficit.

With this modified circuit arrangement only the positive portion of the differential current from differential amplifier 2 in excess of its standing current Iy is fed to the multiplying transistors T13, T14, T15 and T16 and thus to the output inversion circuits.

Analysis of Modified Four Quadrant Multiplier Action

In the following analysis, it is assumed for the sake of simplicity that the device beta values are infinite.

$$
\begin{aligned}
I4 &= \text{sgn.}(Iy + Vy/Ry - Ip) \\
&\text{where Ip is the current flowing in lines 10 and 11} \\
&= \text{sgn.}(Vy/Ry + \delta Iy) \\
\text{where sgn.}(A) &= 0 \text{ for } A < 0 \\
\text{sgn.}(A) &= A \text{ for } A > 0 \\
\delta Iy &= (Iy - Ip) \\
\text{similarly } I3 &= \text{sgn.}(Iy - Vy/Ry - Ip) \\
&= \text{sgn.}(-Vy/Ry + \delta Iy)
\end{aligned}
$$

Modifying the analysis of the conventional prior art multiplier, the following expression is obtained.

$$IO = \text{sgn}\cdot((-Vy/Ry) + \delta Iy)(\Delta 1 + \Delta 3)/(1 + \Delta 1 \Delta 3) + \text{sgn}\cdot((Vy/Ry) + \delta Iy)(\Delta 2 - \Delta 3)/(1 - \Delta 2 \Delta 3)$$

When Vy=0 and δIy is positive $$IO = \delta Iy((\Delta 1 + \Delta 3)/(1 + \Delta 1 \Delta 3) + (\Delta 2 + \Delta 3)/(1 - \Delta 2 \Delta 3))$$

It is possible without the use of trim to achieve a ratio of δIy/Iy of 0.5% which from the above expression gives a twenty-fold improvement in the zero output offset error. Further more the error introduced by the differential to single ended current converter is also made to be proportional to the Vy input signal level rather than the tail current Iy as in the prior art multiplier. Finally, it is further possible by making δI slightly negative to ensure that throughout the tolerance range that IO=0 for Vy=0. Making δI more negative will produce a 'dead band' which can be useful in applications such as feedback control systems to avoid mechanisms 'hunting' for a null value.

What is claimed is:

1. In a multiple circuit in which the multiplication of two signal values is achieved by means of a pair of differentially connected transistors having respective control electrodes to which a differential voltage representative of a first electrical value to be multiplied is applied, and having a tail connection connected to one of two differential outputs of a differential amplifier, to the inputs of which a differential voltage representing a second electrical value to be multiplied is applied, the improvement comprising current supply means connected to said one output of said differential amplifier to supply current thereto, the magnitude of which is such that with zero differential voltage applied as input to the differential amplifier, the standing current of said amplifier is supplied solely from said current supply means and no current flows through the tail connection of said differentially connected pair of transistors, said magnitude constituting a finite non-zero value equal to the standing current of said differential amplifier into said one output thereof.

2. A multiplier circuit as claimed in claim 1, in which the standing current of said differential amplifier is defined by a constant current source forming part of said differential amplifier and said current supply means comprises a further constant current source identical to that forming part of said differential amplifier and a current mirror arrangement the input of which is connected to said further constant current source and having an output line connected to said one output of said differential amplifier.

3. A multiplier circuit, in which the multiplication of two signal values is achieved by means of a pair of differentially connected transistors having respective control electrodes to which a differential voltage representative of a first electrical value to be multiplied is applied, and having a tail connection connected to one of two differential outputs of a differential amplifier, to the inputs of which a differential voltage representing a second electrical value to be multiplied is applied, said multiplier circuit comprising current supply means connected to said one output of said differential amplifier to supply current thereto, the magnitude of which is such that with zero differential voltage applied as input to the differential amplifier, the standing current of said amplifier is supplied solely from said current supply means and no current flows through the tail connection of said differentially connected pair of transistors, and in which the standing current of said differential amplifier is defined by a constant current source forming part of said differential amplifier and said current supply means comprises a further constant current source identical to that forming part of said differential amplifier and a current mirror arrangement the input of which is connected to said further constant current source and having an output line connected to said one output of said differential amplifier, and a catching diode is connected between said one output of said differential amplifier and a reference voltage, the arrangement being such that the current drawn by said differential amplifier output in excess of said standing current is supplied through the catching diode associated therewith.

4. A multiplier circuit in which the multiplication of two signal values is achieved by means of a pair of differentially connected transistors having respective control electrodes to which a differential voltage representative of a first electrical value to be multiplied is applied, and having a tail connection connected to one of two differential outputs of a differential amplifier, to the inputs of which a differential voltage representing a second electrical value to be multiplied is applied, said multiplier circuit comprising current supply means connected to said one output of said differential amplifier to supply current thereto, the magnitude of which is such that with zero differential voltage applied as input to the differential amplifier, the standing current of said amplifier is supplied solely from said current supply means and no current flows through the tail connection of said differentially connected pair of transistors, and in which the standing current of said differential amplifier is defined by a constant current source forming part of said differential amplifier and said current supply means comprises a further constant current source identical to that forming part of said differential amplifier and a current mirror arrangement the input of which is connected to said further constant current source and having an output line connected to said one output of said differential amplifier, and a catching diode is connected between said one output of said differential amplifier and a reference voltage, the arrangement being such that current drawn by said differential amplifier output in excess of said standing current is supplied through the catching diode associated therewith, and in which said input to said current mirror arrangement includes additional semiconductor devices to compensate for alpha loss caused by similar semiconductor devices forming said differential amplifier.

5. In a multiplier circuit in which the multiplication of two signal values is achieved by means of first and second pairs of differentially connected transistors, each having control electrodes to which a differential voltage representative of a first electrical value to be multiplied is applied, each said pair having a tail connection connected respectively one to each of two differential outputs of a differential amplifier, to the inputs of which is applied a differential voltage representing a second electrical value to be multiplied and the output connection of said first and second pairs of differentially connected transistors being cross-coupled in a sense so as to produce four quadrant multiplication of said two signal values, said differential amplifiers having current source means defining standing currents through said amplifiers, the improvement comprising current supply means coupled to said source means and connected to both outputs of said differential amplifier at a respective node between each said amplifier and said tail connection connected thereto, in order to supply said standing current to the respective said amplifier, the magnitude of which is such that with zero differential voltage applied as inputs to the differential amplifier, and the standing current for said differential amplifier are supplied solely from said current supply means, and no current flows through either tail connection of said first and second pairs of differentially connected transistors.

6. A multiplier circuit as claimed in claim 5, in which the standing currents for said differential amplifier are defined by a constant current source forming part of said differential amplifier and said current supply means comprises a further contact current source identical to that forming part of said differential amplifier and a current mirror arrangement the input of which is connected to said further constant current source and having two output lines each of which is connected respectively to one or other of the two differential outputs of said differential amplifier.

7. A multiplier circuit in which the multiplication of two signal values is achieved by means of first and second pairs of differentially connected transistors, each having control electrodes to which a differential voltage representative of a first electrical value to be multiplied is applied, each said pair having a tail connection connected respectively one to each of two differential outputs of a differential amplifier, to the inputs of which is applied a differential voltage representing a second electrical value to be multiplied and the output connection of said first and second pairs of differentially connected transistors being cross-coupled in a sense so as to produce four quadrant multiplication of said two signal values, said multipliercircuit comprising current supply means connected to both outputs of said differential amplifier in order to supply current thereof, the magnitude of which is such that with zero differential voltage applied as inputs to the differential amplifier, the standing currents for said differential amplifier are supplied solely from said current supply means, and so current flows through either tail connection of said first and second pairs of differentially connected transistors, and in which the standing currents for said differential amplifier are defined by a constant current source forming part of said differential amplifier and said current supply means comprises a further contact current source identical to that forming part of said differential amplifier and a current mirror arrangement the input of which is connected to said further constant current source and having two output lines each of which is connected respectively to one or other of the two differential outputs of said differential amplifier, and in which an individual catching diode is connected respectively between each output of said differential amplifier and a reference voltage, the arrangement being such that current drawn by a differential amplifier output in excess of said standing current is supplied through the catching diode associated therewith.

8. A multiplier circuit, in which the multiplication of two signal values is achieved by means of first and second pairs of differentially connected transistors, each having control electrodes to which a differential voltage representative of a first electrical value to be multiplied is applied, each said pair having a tail connection connected respectively one to each of two differential outputs of a differential amplifier, to the inputs of which is applied a differential voltage representing a second electrical value to be multiplied and the output connection of said first and second pairs of differentially connected transistors being cross-coupled in a sense so as to produce four quadrant multiplication of said two signal values, said multipliercircuit comprising current supply means connected to both outputs of said differential amplifier in order to supply current thereof, the magnitude of which is such that with zero differential voltage applied as inputs to the differential amplifier, the standing currents for said differential amplifier are supplied solely from said current supply means, and so current flows through either tail connection of said first and second pairs of differentially connected transistors, and in which the standing currents for said differential amplifier are defined by a constant current source forming part of said differential amplifier and said current supply means comprises a further contact current source identical to that forming part of said differential amplifier and a current mirror arrangement the input of which is connected to said further constant current source and having two output lines each of which is connected respectively to one or other of the two differential outputs of said differential amplifier, and said input to the current mirror arrangement includes additional semiconductor devices to compensate for alpha loss caused by similar semiconductor devices forming said differential amplifier.

* * * * *